US007385124B2

(12) United States Patent
Clemente

(10) Patent No.: US 7,385,124 B2
(45) Date of Patent: Jun. 10, 2008

(54) CLAMPING MEMBER FOR A VIOLIN SHOULDER REST

(75) Inventor: Vittorio Clemente, Ronchi Dei Legionari (IT)

(73) Assignee: The Kun Shoulder Rest, Inc., Ottawa (CA)

( * ) Notice: Subject to any disclaimer, the term of this patent is extended or adjusted under 35 U.S.C. 154(b) by 189 days.

(21) Appl. No.: 10/545,913

(22) PCT Filed: Dec. 23, 2003

(86) PCT No.: PCT/CA03/02022

§ 371 (c)(1),
(2), (4) Date: Feb. 3, 2006

(87) PCT Pub. No.: WO2004/077398

PCT Pub. Date: Sep. 10, 2004

(65) Prior Publication Data

US 2006/0174743 A1 Aug. 10, 2006

(30) Foreign Application Priority Data

Feb. 26, 2003 (CA) ..... 2420005

(51) Int. Cl.
*G10D 1/02* (2006.01)

(52) U.S. Cl. ..... 84/278

(58) Field of Classification Search ..... 84/278–281
See application file for complete search history.

(56) References Cited

U.S. PATENT DOCUMENTS 2,478,530 A 8/1949 Hall
2,697,374 A 12/1954 Ungh
2,747,452 A 5/1956 Goldberger
3,631,754 A 1/1972 Kun
6,031,163 A 2/2000 Cullum et al.
6,278,044 B1 8/2001 Ruan
7,064,258 B2 * 6/2006 Mea ..... 84/278
7,265,284 B2 * 9/2007 Muir et al. ..... 84/279

FOREIGN PATENT DOCUMENTS

CA 2198320 8/1998

* cited by examiner

*Primary Examiner*—Kimberly Lockett
(74) *Attorney, Agent, or Firm*—Novak Druce & Quigg, LLP

(57) ABSTRACT

The inventive clamping member is a rigid clamp having a generally "U"-shaped configuration the base of which is defined by two arms each terminating in an upwardly directed clamping finger adapted to engage the rim of a bottom of a violin or the like at opposed sides of the body of the instrument. A pivot, usually in the form of a threaded stem projects from the base of the "U" in a direction opposite to that of the projection of the clamping fingers. It normally secures free pivotal mounting of the clamping members at the ends of a shoulder rest bridge. The stem defines an axis of pivot of the clamping member which is offset to one of the clamping fingers, whereby the two arms are of uneven length. The shorter arm is relatively proximal to the tail of the instrument, while the longer arm is relatively distal from the tail. The advantage of the clamping members is in that they each enable the clamping of a shoulder rest to an instrument at opposed sides of a transverse axis of the body of the instrument, at which the body is widest, while allowing the location of the bridge of the shoulder rest to be closer to the chin rest of the instrument to improve convenience

17 Claims, 4 Drawing Sheets

CLAMPING MEMBER FOR A VIOLIN SHOULDER REST

This application is a §371 National Stage Application of International Application No. PCT/CA2003/002022, filed on 23 Dec. 2003, claiming the priority of Canadian Patent Application No. 2,420,005 filed on 26 Feb. 2003.

The present invention relates to a shoulder rest for bowed instruments such as violin or viola.

In particular, the invention relates to clamping members of a clamp system of a shoulder rest having a bridge between opposed clamping members. The bridge is rigid but may have some limited flexibility. It is provided at each end with an end member which is generally L-shaped where one arm of the L is fixedly secured to the top surface of the bridge, while the other arm of the L supports, directly or indirectly, the clamping member. The two opposed L-shaped members carry clamping members, but also provide additional flexibility which allows a limited spreading apart of the opposed clamping members so as to firmly but removably attach the shoulder rest to a violin. Typically, when the shoulder rest is secured to the instrument, the clamping members engage the back rim of the body of the instrument. The clamping members, when attached to an instrument, are strongly but resiliently urged to each other to firmly but releasably grip the rim of the bottom wall thus holding the bridge at a desired spacing from the bottom of the body of the instrument, ready to support the instrument on the shoulder of a player. The clamping members should support the instrument with a clamping force sufficient to prevent inadvertent displacement of the shoulder rest from the instrument. Such displacement might result in a damage to the surface of the bottom of the body of the instrument by projections or the like present on the upper surface of the bridge.

Many different clamping mechanisms for removably attaching a shoulder rest bridge to a violin are known. For instance, U.S. Pat. No. 2,747,452 (Goldberger) issued in 1954 or U.S. Pat. No. 6,278,044 (Ruan) issued in 2001, describe an attachment mechanism comprising a bridge which is supported, near the tail of a violin, at each end by a finger which contacts the respective side of the instrument but generally supports the instrument only in a ledge-like fashion, virtually free of any clamping engagement with the rim. The bridge further supports a relatively long clamping arm which is urged into a clamping state by a coil spring section at the respective side of the bridge. The two arms thus clamp the body independently of the clamping force, if any, at the first pair of the clamping fingers near the tail of the instrument.

The drawback of these arrangements is primarily in a cumbersome, complex way the spring-like coil elements have to be anchored to the bridge. The flexing force of the bridge is not transmitted to the clamping force of both clamping fingers. Such force is determined virtually solely by the force generated at the coil spring section of each arm.

The height adjustment cannot be effected in the Goldberger patent and can only be effected in a very limited and cumbersome way in the Ruan design. Since there is an independent clamping force developed at each of the two arms remote from the tail of the instrument, but not at the lower fingers near the tail end, the strength of the securement to an instrument is insufficient.

A large number of prior art patents describes this type of the clamp systems using freely pivotable, rigid U-shaped clamps. Reference may be had, for instance, to U.S. Pat. No. 6,031,163 (Cullum et al.) assigned to the Kun Shoulder Rest, Inc., U.S. Pat. No. 2,697,374 (Ungh) issued Dec. 21, 1964 or U.S. Pat. No. 3,631,754 (Kun), all of which are incorporated herein by reference. As already mentioned, the U-shaped clamping members of these shoulder rest are preferably integrally formed elements. They are all pivotable about an axis which is located centrally between the clamping fingers. This arrangement secures a uniform pressure exerted at each finger engaging the instrument. This clamping system is satisfactory in many applications. Its advantage is in a simple structure easily adaptable for different sizes of a violin readily allowing for adjustment of the spacing between the bridge and the body of the instrument.

However, it is still desirable to further improve the comfort of the player of the instrument by moving the location of the bridge as close to the chin rest of the instrument as possible. This is difficult, if not impossible, with the existing type of rigid U-shaped clamp members.

It is an object of the present invention to alleviate the above problem and to fully utilize both the use of the freely pivoted U-shaped members but also to secure that, where the shoulder rest is required to be attached relatively close to the back end of the body of the instrument, the tendency of the shoulder rest to slip off the body is at least substantially limited and often eliminated.

It is another object of the invention to enable an inexpensive converting of an existing shoulder rest from a regular arrangement of the U-shaped members to a different type providing an increased stability.

In general terms, the invention provides a rigid U-shaped clamp member for a violin or the like instrument shoulder rest adapted to engage a back rim of the body at one side of the body, comprising a first arm and a second arm. The arms are rigidly connected, preferably integrally formed, with each other. The arms adjoin each other for a free pivotal movement in common at a pivot section, about a pivot axis generally perpendicular to elongation of said arms. A first clamp finger is disposed at a free end of said first arm, and a second clamp finger at a free end of said second arm. The clamp fingers are provided for engaging a side portion of a violin or the like body. The first and second clamp fingers project each in a direction generally parallel with said pivot axis. The arms are of uneven length, whereby said pivot axis is offset to a location distal from the clamp finger of said first arm and proximal to the clamp finger of said second arm. The length of said first arm is at least about twice that of the second arm. The first clamp finger is adapted to engage a side portion of a violin or the like body at a location proximal to the waist of an associate violin or the like, and the second clamp finger is adapted to engage the same side portion at a location distal from the waist and proximate to the tail of an associated instrument.

The invention will now be described in detail with reference to the accompanying simplified, diagrammatic, not-to-scale drawings, wherein FIG. 1 is a perspective view of the shoulder rest incorporating the features of the present invention, with one of the clamping members shown detached;

Figure 1:
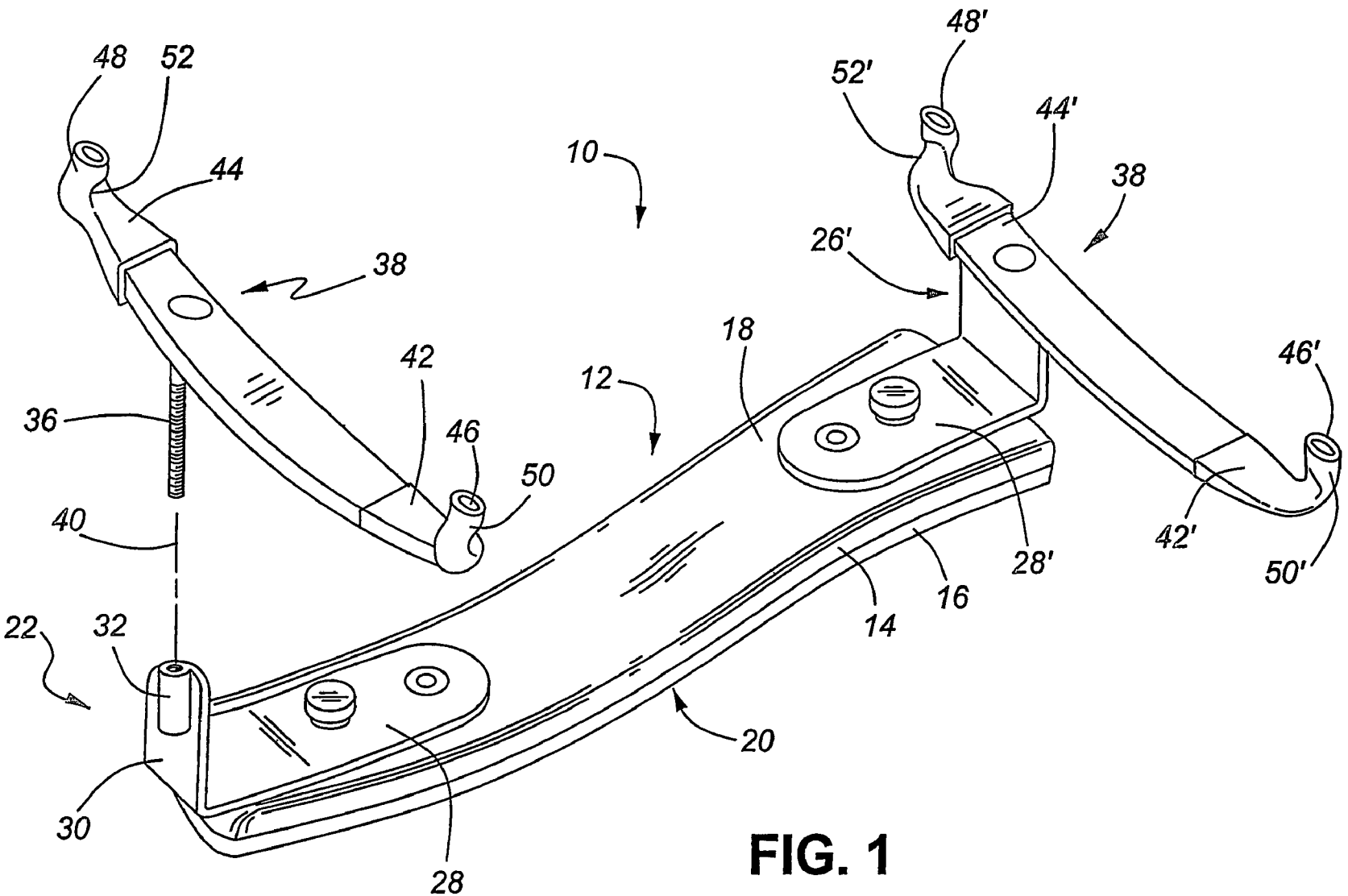
Figure 2:
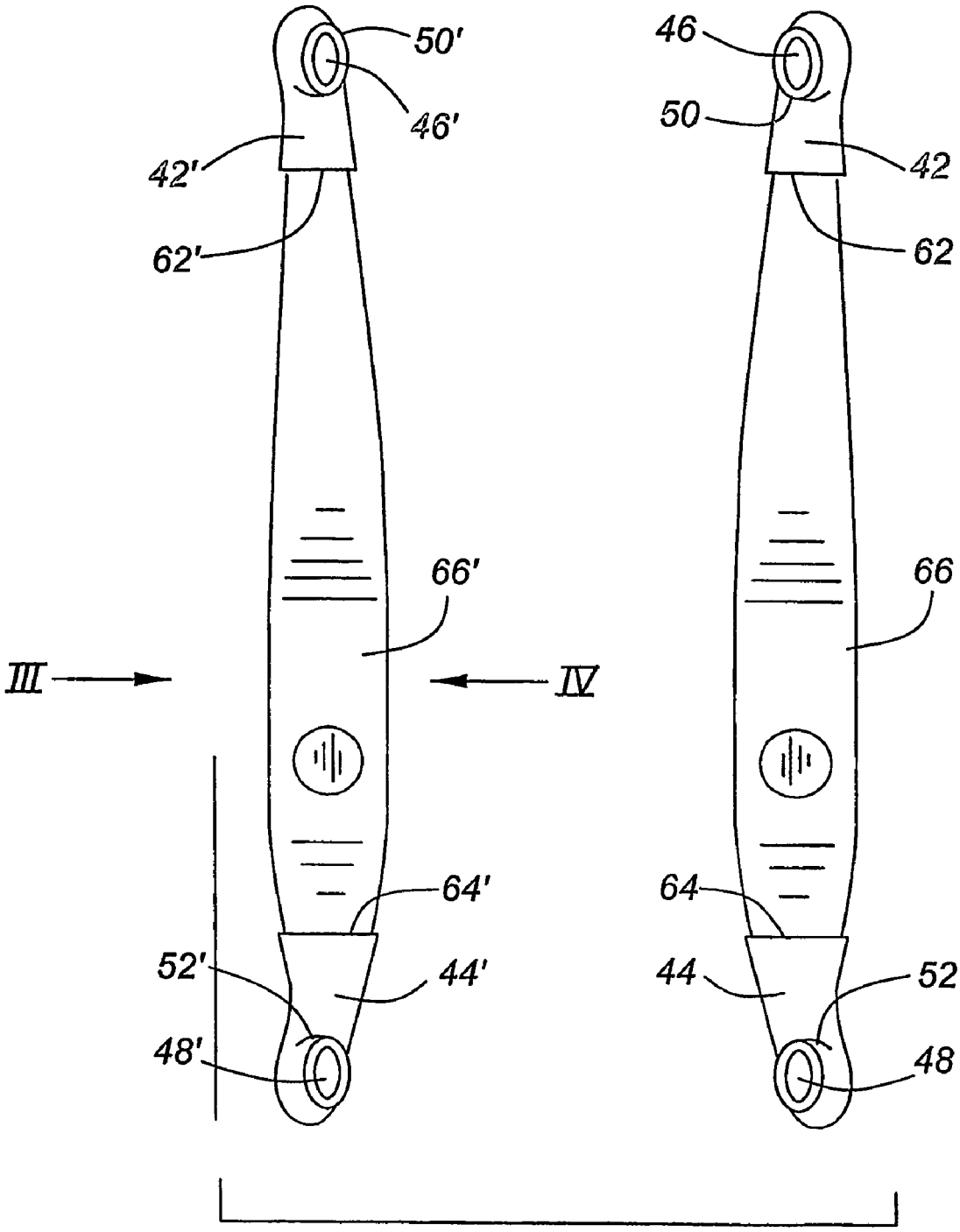
FIG. 2 is a top plan view showing a pair of inventive clamping members of a shoulder rest.
Figure 3:
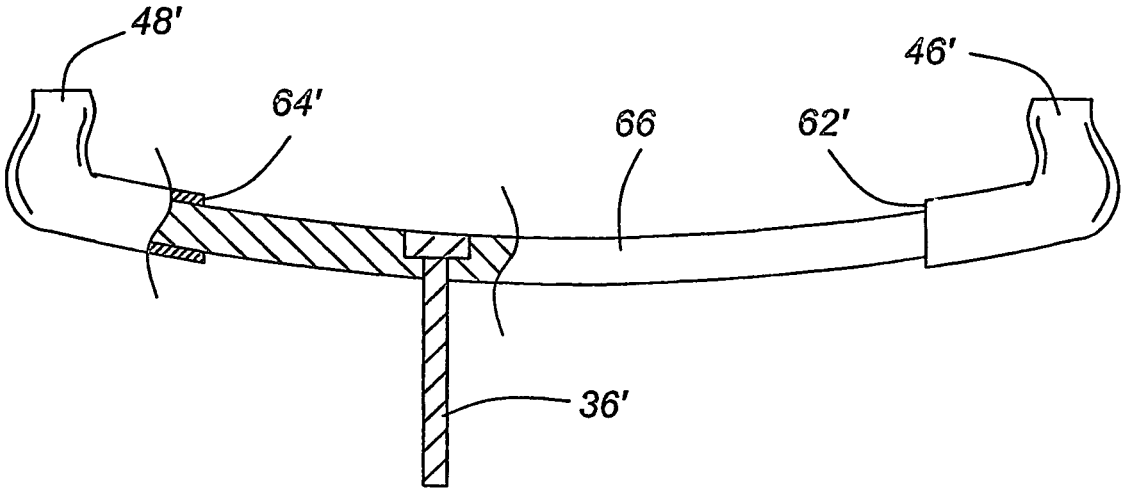
FIG. 3 is a side view, partly in section of the clamping member, taken in the direction III-III of FIG. 2.
Figure 4:
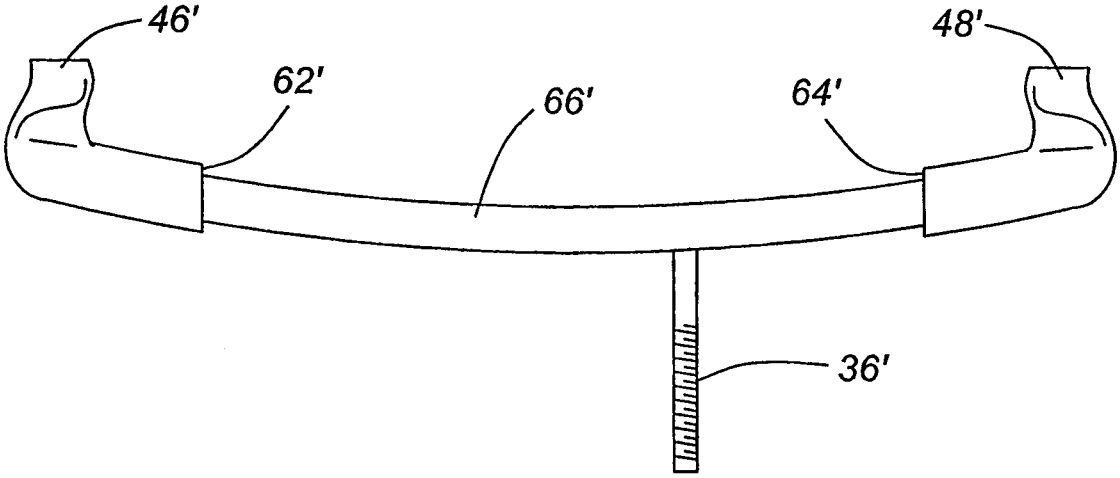
FIG. 4 is a side view of the clamping member, taken in the direction IV of FIG. 2.

The shoulder rest 10 of FIG. 1 is intended for use with a violin, viola or other similar bowed instruments. Therefore, whenever reference is made to a violin, it is to be understood that other similar instruments are included in such term. For simplicity, certain parts normally present in a shoulder rest but not associated with the present invention, are not shown in the drawings.

The shoulder rest 10 includes an elongated bridge 12 comprised of an upper portion 14 and of a soft padding 16, usually adhesively secured to the underside of the upper portion 14. As is known, the upper portion is made from a suitable stiff material, for instance, a glass fibre reinforced plastic material. The upper portion 14 is stiff but does have a limited resiliency so that some resilient flexing of the bridge is possible. The upper portion 14 defines an upper surface 18 of the bridge 12, and the padding 16 the lower surface 20 which, in use, rests on the shoulder of the player of the instrument.

The bridge has a first end 22 and a second end 24. A usually generally L-shaped first base 26, has a horizontal arm 28 which is fixedly secured to the upper surface 18 of the bridge at a predetermined location adjacent to the first end 22. As is well known, the position of the arm 28, is adjustable along the elongation of the bridge. The upright of the L-shaped first base 26 forms an upwardly projecting support 30 which carries a base portion 32 with a vertical threaded bore 34. The bore 34 receives a threaded stem 36. The upper end of the stem 36 is fixedly secured to a rigid, generally U-shaped first clamp member 38. The clamp member 38 is disposed at a predetermined spacing from the upper surface 18 which is adjustable by simply threading the stem 36 into or out of the bore 34, depending on the physique of the user. The stem 36 and its associated bore permit a free pivotal movement of the clamp member 38 about the pivot axis 40 defining a pivot section of the clamp member 38. The axis 40 is normally generally perpendicular to the upper surface 18 of the bridge. Those skilled in the art will appreciate that the reference to the L-shaped first base 26 is meant solely as an exemplary embodiment since many mechanical substitutes of such member, including an upwardly projecting support integrally molded with the bridge and many other embodiments well known from prior art.

The generally U-shaped clamp member 38 comprises a rigid first arm 42 which is integrally formed with a generally co-extensive rigid second arm 44. At the free end of the first arm 42, a first clamping finger 46 projects in a direction away from the bridge 12. Similarly, at the free end of the second arm 44, a second clamping finger 48 projects in the same direction. The fingers 46, 48 are adapted to engage the rim of a bottom of the body of an associated instrument on one side of the instrument. This is preferably achieved by the concave recesses 50, 52 of the respective fingers. Note that the recesses are open in a direction toward the opposite second end 24 of the bridge. FIG. 1 shows that the length of the first arm 42 is approximately twice the length of the shorter arm 44. In other words, the first clamping finger 46 is distal from the pivot axis 40 and the second clamping finger 48 is proximate to the pivot axis 40.

Thus, the fingers 46 and 48 form two uprights of the said U-shape, while the arms 42, 44 define a base thereof. The second clamp member 38' and its associated base at the opposite, second end 24 of the bridge 12 is, generally, a mirror image of the first clamp member 38 and therefore does not need to be described in detail.

It will be observed from the drawings that the arm portion of each clamp member is arcuately curved. The arc maintains the arm portion of each clamp member spaced from the surface of the back of the instrument. Accordingly, while the clamping fingers engage the rim of the bottom wall, the rest of the clamp member remains spaced from the surface of the back and does not inhibit the quality of the tone of the instrument.

Figure 5:
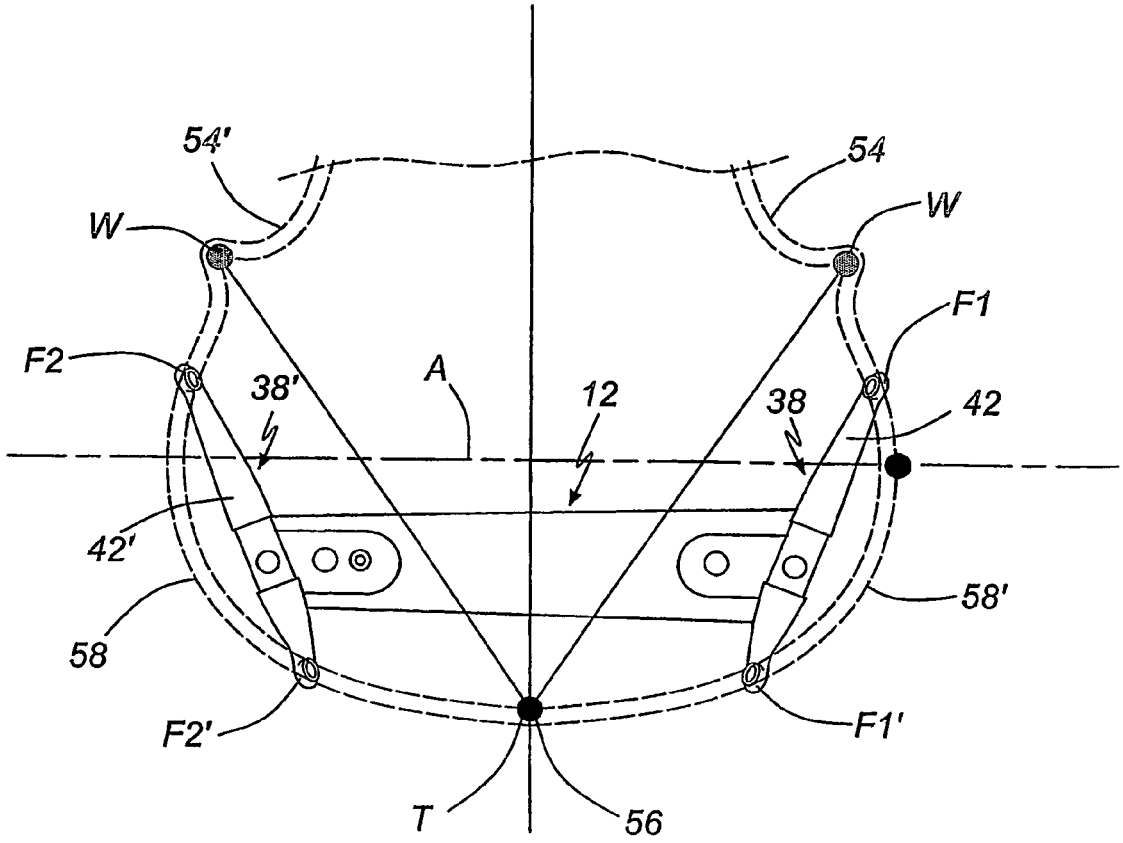
FIG. 5 is a diagrammatic bottom plan view of the shoulder rest incorporating the clamping members of the present invention attached to the body of a violin.

Reference may now be had to FIG. 5 which shows a diagrammatic representation of the shoulder rest just described attached to the rim of a bottom of the instrument. The geometry of the contour of the lower part of the contour of the rim is indicated only in a diagrammatic way. The part of the rim shown includes a pair of two opposed waist portions 54, 54', a central tail portion 56 and an arc 58, 58' at each side of the body extending between the respective waist portion 54, 54' and the tail portion 56. A reference line 60, extends between a point W located at the waist portion 54 and point T coincident with the tail portion 56. The transverse line across the widest part of the rim is designated with letter A.

Points F1, F1' designate locations at which the first and second finger 46, 48 of the first clamp member engage one side of the rim. Points F2, F2' are locations at which the first and second finger 46', 48' of the second clamp member 38' engage the opposite side of the rim. While the geometry of the points of engagement of the fingers with the rim can be modified, it preferred that the fingers of each of the clamp members 38, 38' engage the rim at the opposed sides of the transverse line A. Furthermore, it is preferred, but not absolutely necessary, that the distance between the clamp fingers 46-48, 46'-48' be greater than about one-half but less than about two-thirds of the length of the associated line W-T. This results, of course, in that the clamping force generated by the flexibility of the bridge 12 and of the bases 26, 26' at the respective pivot axes 40, 40' is unevenly distributed to the respective clamping fingers.

The clamping force at the fingers 46, 46' near the waist portions 54, 54' is smaller than that at clamping FIGS. 48, 48'. However, there is sufficient clamping force at all four points, two to each side of the transverse line A. This provides exceptional stability which is superior to that of shoulder rests having independent spring coils associated with the clamping arms. The stability is even increased upon application of pressure on the bridge 12 as the instrument is being played. Compared with the known shoulder rests having rigid U-shaped clamping members, the invention secures the optimum location of the bridge 12 where the longitudinal centerline of the bridge is below the chin rest of the played instrument or very close to such position, thus enhancing the comfort of the player.

The accompanying drawings show that the clamping fingers 46, 48, 46', 48' and a portion of their arms 42, 44, 42', 44' are covered by a soft, protective coating sections 62, 64, 62', 64'. They prevent the scratching of the instrument by the clamping elements. The coating sections of the embodiment shown are produced by applying to a rigid core 66, 66' a rubber hose in a slip-on fashion. Many other types of the protective coating including an elastomeric layer moulded on the entire U-shaped member are known.

Those skilled in the art will appreciate that many embodiments of shoulder rest can be produced differing from the embodiment described but falling within the scope of the invention as set forth in the accompanying claims.

The invention claimed is:

1. A rigid clamp member for use in a shoulder rest for a violin or the like instrument, said clamp member being adapted to clamping engage a rim of a bottom of a body of an associated instrument, said clamp member comprising:

(a) a first arm and a second arm fixedly connected to each other and adjoining each other for pivotal movement in common at a pivot section disposed between said arms and defined by a pivot axis generally perpendicular to elongation of said arms;

(b) a first clamping finger at a free end of said first arm and a second clamping finger at a free end of said second arm, for engaging a predetermined side portion of a rim of a bottom of an associated instrument, said first and second clamping fingers projecting each in a direction generally parallel with said pivot axis, from the respective arm such that the arms and the clamping fingers define a rigid, generally U-shaped configuration, in which said arms define the base of the U and said fingers define the upright of the U;

(c) said arms being of uneven length, whereby said pivot axis is offset to a location relatively distal from the clamping finger of said first arm and relatively proximal to the clamping finger of said second arm.

2. The clamp member of claim 1, wherein the length of said first arm is at least about twice that of the second arm.

3. A clamp member of claim 1, wherein said first clamping finger is adapted to engage a rim of a bottom of an associated instrument at a first contact point proximal to a waist of an associated instrument, and said second clamping finger is adapted to engage the rim at a second contact point distal from the waist of an associated instrument.

4. The clamp member of any one of claim 1, wherein the two arms of the clamping member are arcuately downwardly curved in a direction opposite to the direction of the projection of the clamping fingers from said arms.

5. A rigid clamp member for use in a shoulder rest for a violin or the like instrument, comprising:

(a) a first arm and a second arm integrally formed and adjoining each other for pivotal movement in common at a pivot section disposed between said arms and defined by a pivot axis generally perpendicular to elongation of said arms;

(b) a first clamping finger at a free end of said first arm and a second clamping finger at a free end of said second arm, for engaging a predetermined side portion of a rim of a bottom of an associated instrument, said first and second clamping fingers projecting each in a direction generally parallel with said pivot axis, from the respective arm such that the arms and the clamping fingers define a rigid, generally U-shaped configuration in which said arms define the base of the U and said fingers define the uprights of the "U";

(c) said arms being of uneven length, whereby said pivot axis is offset to a location relatively distal from the clamping finger of said first arm and relatively proximal to the clamping finger of said second arm.

6. The clamp member of claim 5, wherein the length of said first arm is at least about twice that of the other arm.

7. The clamp member of claim 5, wherein said first clamp finger is adapted to engage a rim of a bottom of an instrument at a first contact point proximal to a neck of an associated instrument, and said second clamp finger is adapted to engage the the rim at a second contact point distal from the neck.

8. The clamp member of any one cf claims claim 5, wherein the two arms of the clamping member are arcuately downwardly curved in a direction opposite to the direction of the projection of the clamping fingers from said arms.

9. A set of clamp members for a shoulder rest for a violin or the like instrument, comprised of a first clamp member and a second clamp member, said first clamp member comprising:

(a) a first arm and a second arm integrally formed and adjoining each other for pivoting in common at a pivot section defined by a pivot axis generally perpendicular to elongation of said arms;

(b) a first clamping finger at a free end of said first arm, and a second clamping finger at a free end of said second arm, for engaging one side portion of a back rim of a body of an associated instrument, said first and second clamping fingers projecting from the respective arm, each in a direction generally parallel with said pivot axis such that the arms and the clamp fingers define a rigid, generally U-shaped configuration in which said arms define the base of the U;

(c) said arms being of uneven length, whereby said pivot axis is offset to a location relatively distal from the clamp finger of said first arm and relatively proximal to the clamp finger of said second arm;

(d) said second clamp member comprising:

(e) a first arm and a second arm integrally formed and adjoining each other for pivotal movement in common at a pivot section defined by a pivot axis generally perpendicular to elongation of said arms;

(f) a first clamping finger at a free end of said first arm, and a second clamping finger at a free end of said second arm, for engaging an opposite side portion of a back rim of a body of an associated instrument, said first and second clamping fingers projecting each in a direction generally parallel with said pivot axis, from the respective arm such that the arms and the clamp fingers define a rigid, generally U-shaped configuration in which said arms define the base of the U;

(g) said arms being of uneven length, whereby said pivot axis is offset to a location relatively distal from the clamping finger of said first arm and relatively proximal to the clamping finger of said second arm.

10. The set of claim 9, wherein the length of said first arm of each said clamp member is at-least about twice that of the second arm.

11. The set of claim 9, wherein the ratio of the length of said first arm to the said second arm of said first clamp members differs from that of the second clamp member.

12. The set of claim 9, wherein said first clamping finger of each of said two clamp members is adapted to engage a respective side of a rim of a back of an associated instrument at a first contact point proximal to a waist portion of an associated instrument, and said second clamping finger of each of said two clamp members is adapted to engage the rim at a second contact point distal from the waist portion of an associated instrument.

13. The set of claim 9, wherein the two arms of each clamping member are arcuately downwardly curved in a direction opposite to the direction of the projection of the clamping fingers from said arms.

14. For use with a violin or a violin-like instrument a shoulder rest of the type including an elongated bridge having a first end and a second end, an upper surface and a lower surface adapted to rest, in use, on the shoulder of a player of the associated instrument, and a pair of clamp members comprised of a first clamp member secured to said bridge at said first end thereof, a second clamp member secured to said bridge at said second end thereof, said clamp members being disposed at a predetermined spacing from each other and from said upper surface and being adapted to clampingly secure therebetween a back rim of an associated instrument to thus secure the bridge to said instrument generally transversely of said back, each clamp member comprising:

(a) a rigid first arm and an integrally formed rigid second arm, said first and second arms being freely pivotable in common relative to the bridge about a pivot located between said arms and having a pivot axis generally perpendicular to the top surface of the bridge;

(b) a first clamping finger at a free end of said first arm, and a second clamping finger at a free end of said second arm, for engaging, respectively, a first side portion and an opposed second side portion of a back rim of a body of a respective instrument, (c) each said first and second finger projecting from the associated arm in a direction away from the bridge such that the arms and the fingers define a rigid, generally U-shaped configuration in which said fingers define the uprights of the U and wherein the pivot axis is disposed between the first and second fingers;

(d) said first clamping finger being distal from the pivot axis and said second clamping finger being proximal to the pivot axis, whereby, with the shoulder rest attached to an instrument, a clamping force developed at said pivot axis and urging the clamp member generally toward the opposed second end of the bridge provides, at said first clamp finger, a clamping force which is smaller than a clamping force at said second clamp finger.

15. The shoulder rest of claim 14, wherein each said first clamping member is configured to engage said back rim at a point relatively proximate to, and each said second clamping member is configured to engage said back at a point relatively distal from, the neck of an associated instrument.

16. The shoulder rest of claim 14, wherein the distance between the fingers of each clamp member being greater than about one-half but less than about two-thirds of the distance between a first end of an arc of the back rim disposed adjacent to the waist of the body of the instrument, and a second end thereof, disposed adjacent to the tail of the body.

17. The shoulder rest of claim 14, wherein the first and second arm of each clamp member is arcuately curved toward said upper surface of the bridge.

* * * * *